US011478069B2

(12) United States Patent
Kilbourne et al.

(10) Patent No.: US 11,478,069 B2
(45) Date of Patent: Oct. 25, 2022

(54) HAIRBRUSH CLEANER

(71) Applicant: TNC Design, Inc., Ormond Beach, FL (US)

(72) Inventors: Courtney Kilbourne, Ormond Beach, FL (US); Anthony Hayes, Ormond Beach, FL (US)

(73) Assignee: TNC Design, Inc., Ormand Beach, FL (US)

( * ) Notice: Subject to any disclaimer, the term of this patent is extended or adjusted under 35 U.S.C. 154(b) by 388 days.

(21) Appl. No.: 16/707,297

(22) Filed: Dec. 9, 2019

(65) Prior Publication Data

US 2021/0169212 A1 Jun. 10, 2021

(51) Int. Cl.
*A46B 17/06* (2006.01)

(52) U.S. Cl.
CPC ..... *A46B 17/06* (2013.01); *A46B 2200/104* (2013.01)

(58) Field of Classification Search
CPC ..... A46B 17/06; A46B 2201/104
See application file for complete search history.

(56) References Cited

U.S. PATENT DOCUMENTS 5,701,626 A * 12/1997 Zara ..... A46B 17/06 15/76
2014/0196230 A1* 7/2014 Pyne ..... A47L 11/4088 15/50.3

* cited by examiner

*Primary Examiner* — Shay Karls
(74) *Attorney, Agent, or Firm* — Mark Malek; Widerman Malek, PL

(57) ABSTRACT

A hairbrush cleaner including a motor compartment, a cleaning compartment receptacle, a cleaning compartment, a motor, and a first cleaning brush. The cleaning compartment receptacle may be secured to a lower portion of the motor compartment. The cleaning compartment may have a lower portion carried by the cleaning compartment receptacle. The motor may have an axle carried within the motor compartment. The first cleaning brush may be suspended within the cleaning compartment receptacle and connected to the motor whereby rotation of the axle of the motor causes rotation of the first cleaning brush.

17 Claims, 11 Drawing Sheets

HAIRBRUSH CLEANER

FIELD OF THE INVENTION

The present invention relates to systems for cleaning a hairbrush. More specifically, the present invention relates to a system to receive a hairbrush and use rotating cleaning brushes to remove hair trapped in the hairbrush bristles.

BACKGROUND OF THE INVENTION

Current hair salon practice requires sanitizing hairbrushes regularly after use. Currently, fluid filled vessels exist in which hairbrush bristles may be placed for sanitization by soaking in a disinfectant. However, these products do not remove hair that has accumulated on the hairbrush bristles during use. Therefore, there exists a need for a product that sanitizes and removes accumulated hair from a hairbrush.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a hairbrush cleaner including a motor compartment, a cleaning compartment receptacle secured to a lower portion of the motor compartment, a cleaning compartment having a lower portion carried by the cleaning compartment receptacle, a motor having an axle carried within the motor compartment, and a first cleaning brush suspended within the cleaning compartment receptacle and connected to the motor whereby rotation of the axle of the motor causes rotation of the first cleaning brush.

The hairbrush cleaner may include a second cleaning brush suspended within the cleaning compartment receptacle and connected to the motor whereby rotation of the motor causes rotation of the second cleaning brush.

The first and second cleaning brushes may include a core and a plurality of cleaning bristles carried by the core.

The cleaning compartment may include a vessel configured to carry a fluid and submerge at least a portion of the first cleaning brush within the fluid.

The hairbrush cleaner may further include a top plate having a first portion secured to a perimeter of an upper portion of the motor compartment and a second portion secured to a portion of a perimeter of an upper portion of the cleaning compartment.

The hairbrush cleaner may additionally include a lid hingedly secured to the top plate and adapted to cover a portion of an upper opening of the cleaning compartment not covered by the top plate.

The lid may include a slot configured to receive a hairbrush having a handle and a plurality of hairbrush bristles, wherein the handle is positioned within the slot and the plurality of hairbrush bristles are positioned within the cleaning compartment.

The top plate may include at least three apertures. A first aperture may be located through an entirety of a thickness of the first portion of the top plate and adapted to receive an axle connected to the motor. A second aperture may be located through an entirety of a thickness of the second portion of the top plate and adapted to carry a first cleaning cylinder adapter. A third aperture may be located through an entirety of a thickness of the second portion of the top plate and adapted to carry a second cleaning cylinder adapter.

The hairbrush cleaner may include a first cleaning cylinder adapter having a first end with a top surface positioned above a top surface of the second portion of the top plate and a second end having a bottom surface with a first cleaning cylinder adapter opening located below the top surface of the second portion of the top plate, wherein a center of the first cleaning cylinder adapter opening is aligned with a center of the second aperture.

The hairbrush cleaner may include a second cleaning cylinder adapter having a first end positioned above a top surface of the second portion of the top plate and a second end having a bottom surface with a second cleaning cylinder adapter opening located below the top surface of the second portion of the top plate, wherein a center of the second cleaning cylinder adapter opening is aligned with a center of the third aperture.

The hairbrush cleaner may include a protuberance secured to the first end of the first cleaning cylinder adapter, extending beyond an outer perimeter of the first cleaning cylinder adapter, and positioned above the top plate.

The hairbrush cleaner may include a first gear carried by the axle connected to the motor, a second gear carried by a first cleaning cylinder adapter protuberance and having teeth interlocked with teeth of the first gear, and a third gear carried by the second cleaning cylinder adapter protuberance and having teeth interlocked with the teeth of the first gear.

The hairbrush cleaner may include a cover plate secured to an upper surface of the top plate forming a cavity therebetween. The first gear, second gear, and third gear may be positioned within the cavity.

The hairbrush cleaner may include a first cleaning cylinder secured to the second end of the first cleaning cylinder adapter and located below the top plate, wherein a center of the first cleaning cylinder is aligned with the center of the first cleaning cylinder adapter and the first cleaning cylinder carries the first cleaning brush.

The hairbrush cleaner may include a second cleaning cylinder secured to the second end of the second cleaning cylinder adapter and located below the top plate, wherein a center of the second cleaning cylinder is aligned with the center of the second cleaning cylinder adapter and the second cleaning cylinder carries the second cleaning brush.

The first cleaning cylinder may further include a sidewall and a slot. The sidewall may define an exterior surface and an interior cavity. The slot may be located through an entirety of a thickness of the sidewall from the exterior surface to the interior cavity. The first cleaning brush may include a protuberance adapted to be received by the slot.

The hairbrush cleaner may include a first and second cleaning cylinder adapter protuberance. The first protuberance may be secured to the first end of the first cleaning cylinder adapter, extend beyond an outer perimeter of the first cleaning cylinder adapter, and be positioned above the top plate. The second protuberance may be secured to the first end of the second cleaning cylinder adapter, extend beyond an outer perimeter of the second cleaning cylinder adapter, and be positioned above the top plate.

BRIEF DESCRIPTION OF THE DRAWINGS

Some embodiments of the present invention are illustrated as an example and are not limited by the figures of the accompanying drawings, in which like references may indicate similar elements.

DETAILED DESCRIPTION OF THE INVENTION

Figure 1:
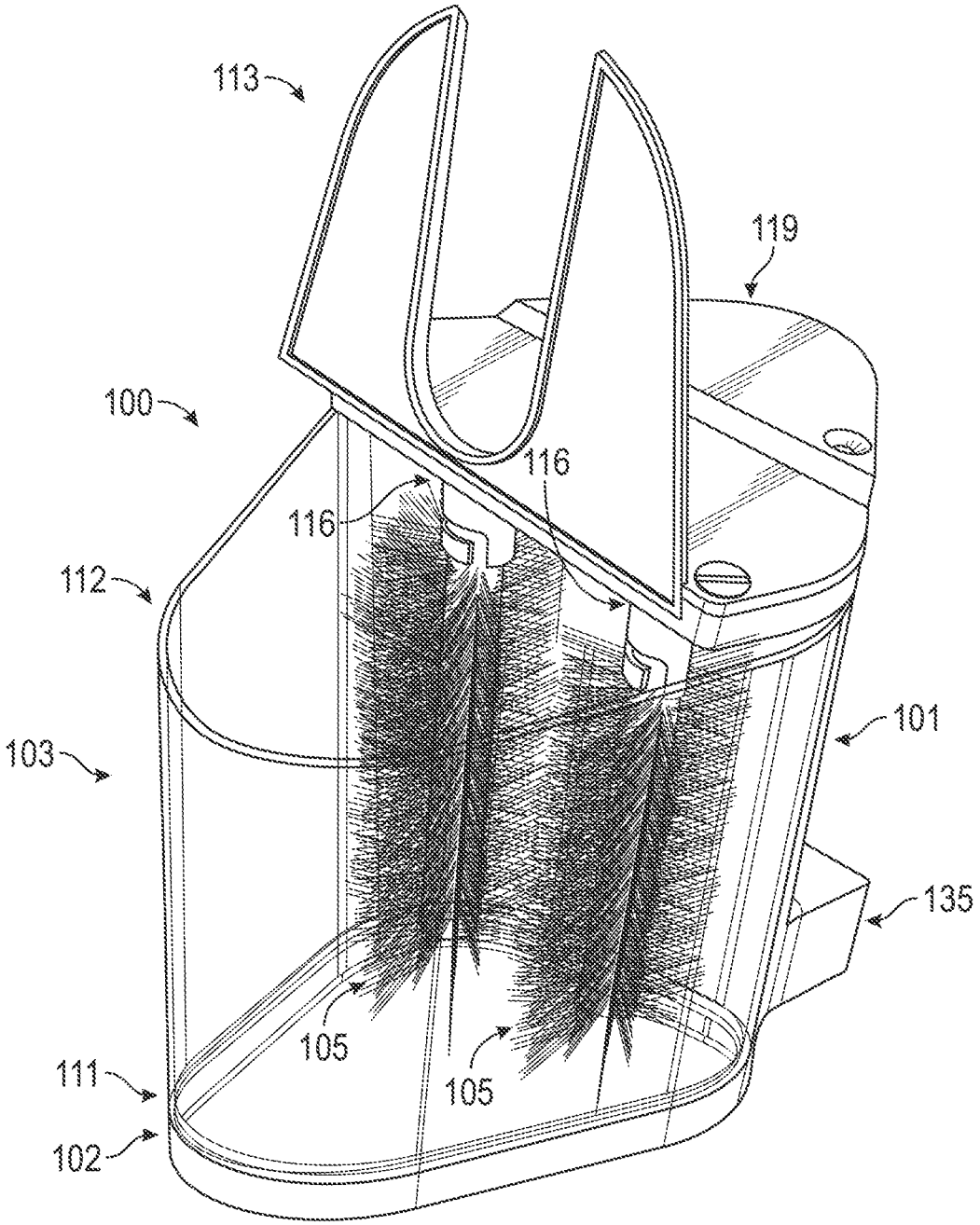
FIG. 1 is a perspective view of a hairbrush cleaner in combination with a hairbrush according to an embodiment of the present invention.
Figure 2:
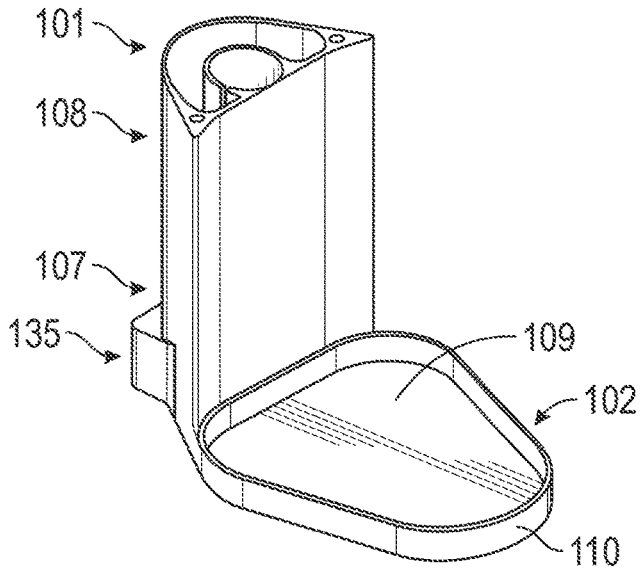
FIG. 2 is a perspective of a motor compartment and cleaning compartment receptacle of the hairbrush cleaner of FIG. 1.
Figure 3:
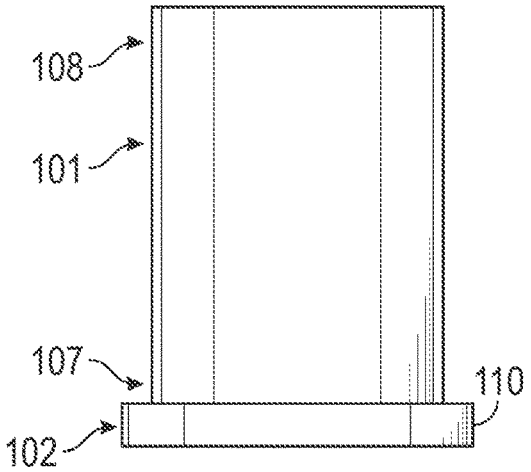
FIG. 3 is a front elevation view of the motor compartment and cleaning compartment receptacle of FIG. 2.
Figure 4:
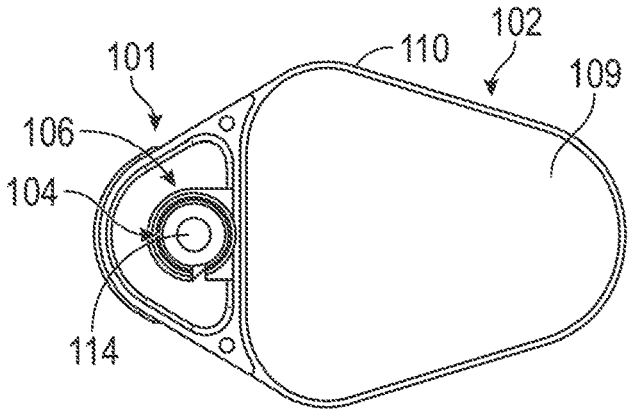
FIG. 4 is a top plan view of the motor compartment and cleaning compartment receptacle of FIG. 2.
Figure 5:
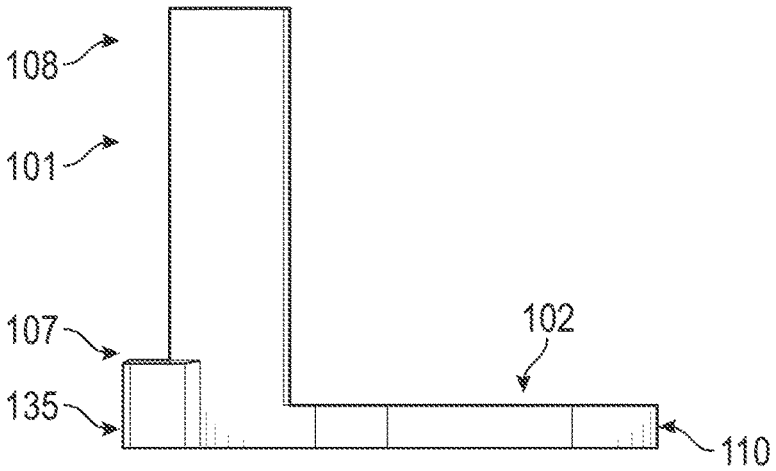
FIG. 5 is a side elevation view of the motor compartment and cleaning compartment receptacle of FIG. 2.
Figure 6:
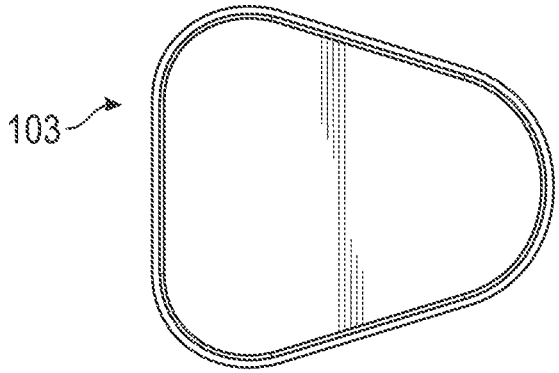
FIG. 6 is a top plan view of the cleaning compartment of the hairbrush cleaner of FIG. 1.
Figure 7:
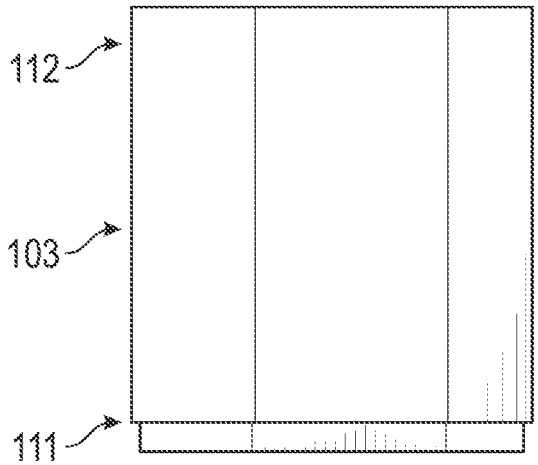
FIG. 7 is a side elevation view of the cleaning compartment of FIG. 6.
Figure 8:
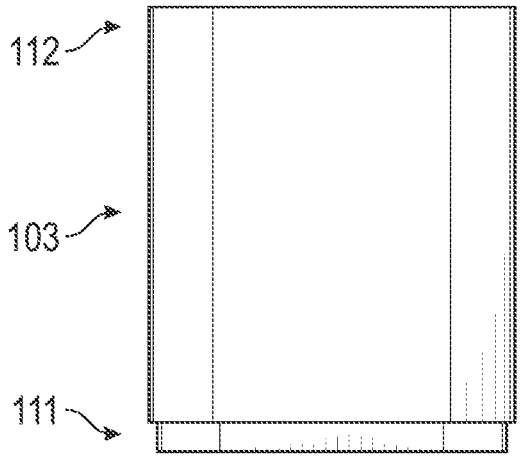
FIG. 8 is a front elevation view of the cleaning compartment of FIG. 6.
Figure 9:
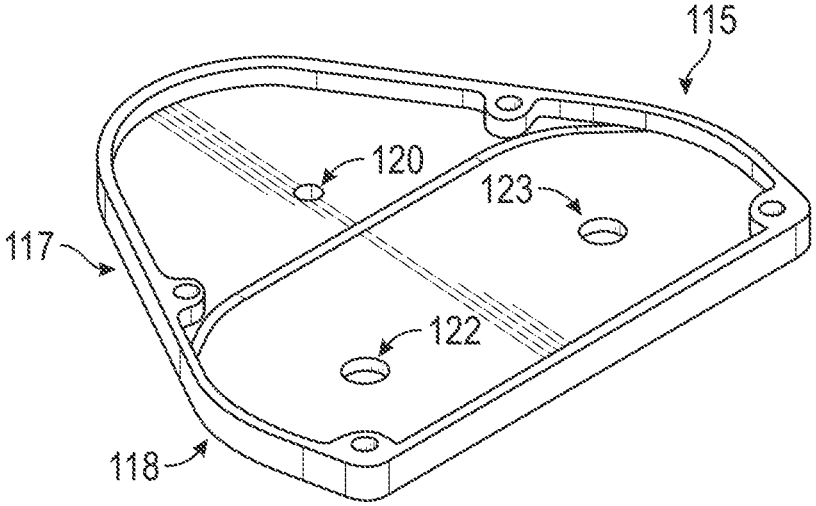
FIG. 9 is a perspective view of the top plate of the hairbrush cleaner of FIG. 1.
Figure 10:
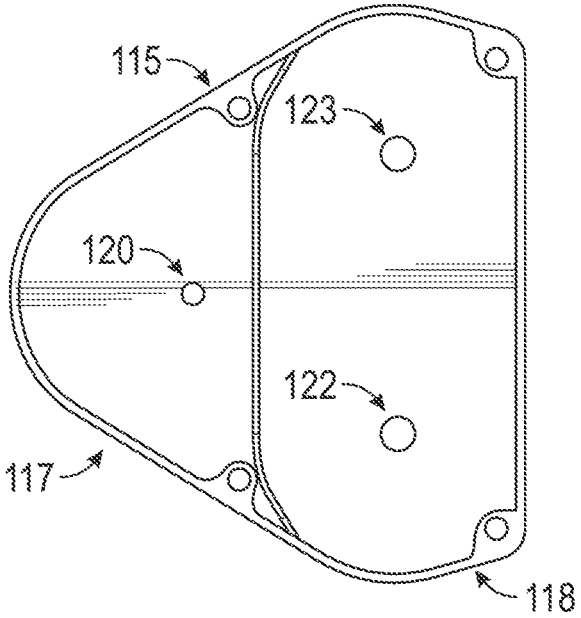
FIG. 10 is a top plan view of the top plate of FIG. 9.
Figure 11:
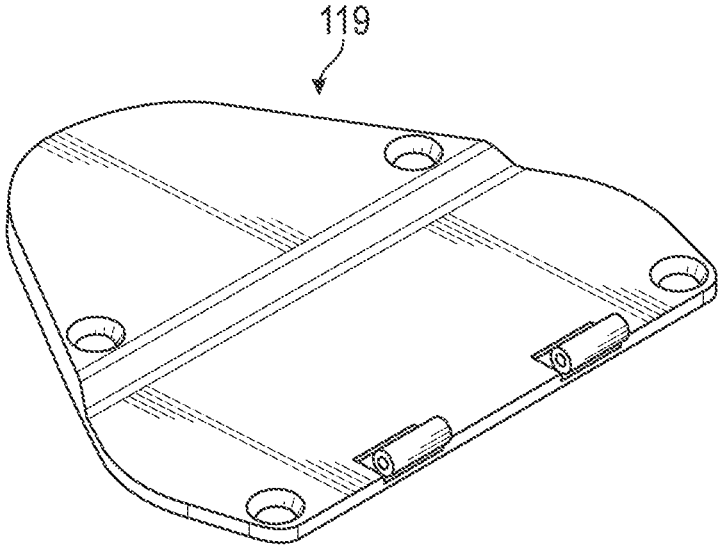
FIG. 11 is a perspective view of the cover plate of the hairbrush cleaner of FIG. 1.
Figure 12:
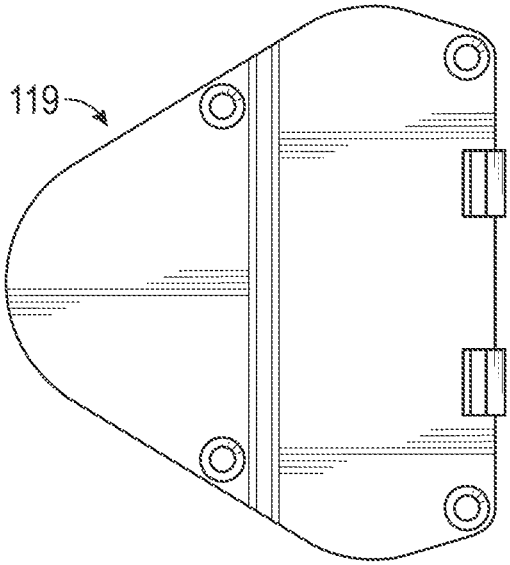
FIG. 12 is a top plan view of the cover plate of FIG. 11.
Figure 13:
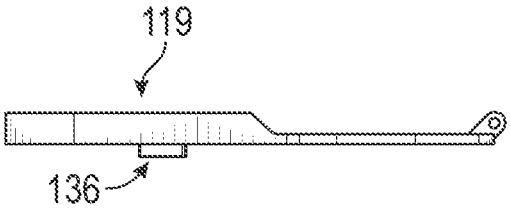
FIG. 13 is a side elevation view of the cover plate of FIG. 11.
Figure 14:
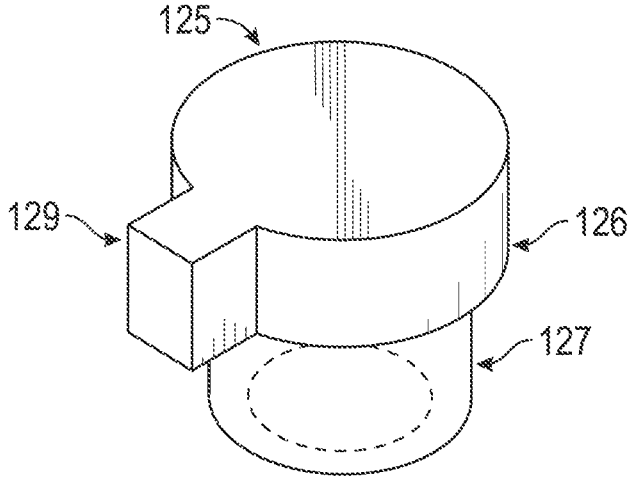
FIG. 14 is a perspective view of the cleaning cylinder adapter of the hairbrush cleaner of FIG. 1.
Figure 15:
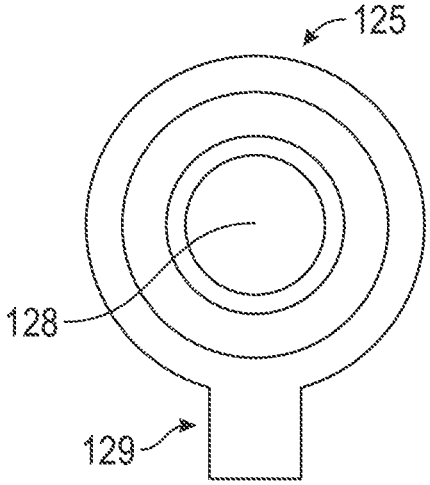
FIG. 15 is a bottom plan view of the cleaning cylinder adapter of FIG. 14.
Figure 16:
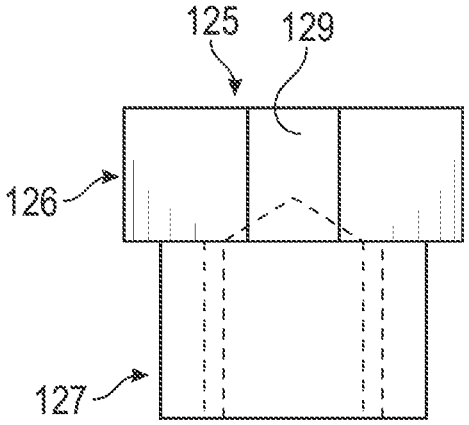
FIG. 16 is a front elevation view of the cleaning cylinder adapter of FIG. 14.
Figure 17:
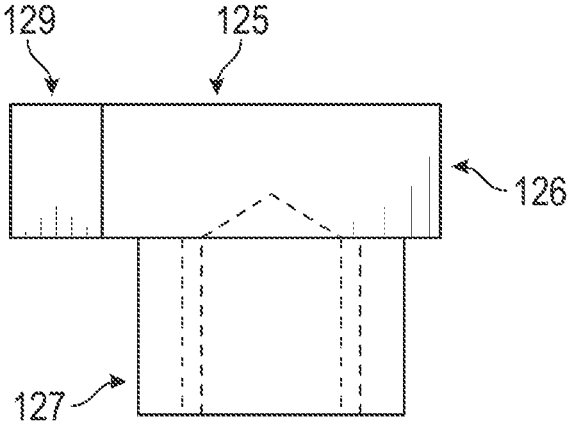
FIG. 17 is a side elevation view of the cleaning cylinder adapter of FIG. 14.
Figure 18:
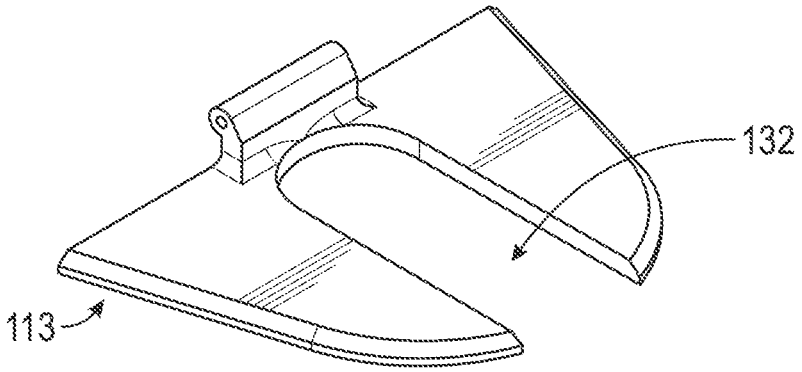
FIG. 18 is a perspective view of the lid of the hairbrush cleaner of FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a hairbrush cleaner 100 including a motor compartment 101, cleaning compartment receptacle 102, cleaning compartment 103, motor 104, and at least one cleaning brush 105.

The motor compartment 101 may be an elongate, hollow structure. An upper portion 108 may have an open end and an opposing, lower portion 107 may be adapted to rest on a flat surface and have a closed end, in which a battery compartment 135 may be located.

At the lower portion 107 of the motor compartment 101, there may be a battery compartment 135. The battery compartment 135 may be sufficiently sized to receive rechargeable or non-rechargeable batteries of sufficient capacity to power the motor 104. The battery compartment 135 may be accessible through an aperture on the bottom side or other location on a lower portion 107 of the motor compartment 101. This aperture may be covered by a removable or hingedly connected battery compartment cover. The batteries may be in electrical communication with a motor 104 carried within the motor compartment 101. The battery compartment 135 may extend backward away from the rest of the motor compartment 101 to increase the surface area of the base of the hairbrush cleaner 100 and increase stability.

The motor compartment 101 may have a cylindrical structure 106 within an interior of the motor compartment 101. The cylindrical structure 106 may secure to an inner side wall of the motor compartment 101. The motor 104 may be carried within the cylindrical structure 106. The cylindrical structure 106 may support the motor 104 and be positioned to provide air space around a majority of the circumference of the cylindrical structure 106. This air space may facility and provide ventilation necessary to prevent the motor 104 from overheating during use.

The motor compartment 101 may be formed from a plastic material and lack sharp edges. In one embodiment, the motor compartment 101 may have an essentially triangular perimeter, in which the angles are rounded to prevent hard angles. In one embodiment, the motor compartment 101 may have an essentially triangular perimeter in which the vertex angle is rounded and a portion of the base is integrated into a side of the cleaning compartment receptacle 102.

A switch may be in electrical communication with the motor 104 and carried by the motor compartment 101. The switch may be positioned to either activate or deactivate the hairbrush cleaner 100. When the hairbrush cleaner 100 is activated, the one or more cleaning brushes 105 may be rotated by the motor 104. When the hairbrush cleaner 100 is deactivated, the one or more cleaning brushes 105 may remain stationary.

The cleaning compartment receptacle 102 may be integrated into a lower portion 107 of the motor compartment 101. The cleaning compartment receptacle 102 may include a planar surface 109 surrounded by a raised lip 110. A portion of the planar surface 109 proximate the motor compartment 101 may not include a raised lip 110. In such an embodiment, the outer wall of the motor compartment 101 may abut the outer perimeter of the planar surface 109 of the cleaning compartment receptacle 102 at the location at which there is no raised lip 110 or the motor compartment 101 outer wall may comprise a portion of the raised lip 110. The cleaning compartment receptacle 102 may be configured to receive the base of a cleaning compartment 103 and retain the cleaning compartment 103 with one or more cleaning brushes 105 within the cleaning compartment 103.

The cleaning compartment 103 may be a hollow vessel with side walls defining an interior volume. The cleaning compartment 103 may have a lower portion 111 with a closed end carried by the cleaning compartment receptacle 102. An upper portion 112 of the cleaning compartment 103 may be open and located beneath a lid 113 and adapted to receive one or more cleaning brushes 105 within the interior volume. Exterior side walls of the cleaning compartment 103 may be recessed along a lower portion 111 of the cleaning compartment 103. The perimeter of the recessed side walls of the lower portion 111 of the cleaning compartment 103 may have the same perimeter profile as the raised lip 110 of the cleaning compartment receptacle 109 and be smaller than the perimeter of the raised lip 110.

The cleaning compartment 103 may be adapted to carry a volume of fluid, such as, by way of example and not as a limitation, water, disinfectant, or the like. The volume of fluid carried by the cleaning compartment 103 may be sufficiently large to cover an entirety of the bristles of a hairbrush positioned within the cleaning compartment 103 with the handle of the hairbrush extending out of the upper portion 112 of the cleaning compartment 103 or positioned proximate thereto.

The motor 104 may be carried within the motor compartment 101. More specifically, the motor 104 may be carried within the cylindrical structure 106 of the motor compartment 101. The motor 104 may be in electrical communication with the batteries, which may be carried within a battery compartment 135 of the motor compartment 101. The motor 104 may include an axle 114. When activated, the motor 104 may rotate the axle, 114, which may cause rotation of one or more cleaning brushes 105.

One or more cleaning brushes 105 may be located in the interior volume of the cleaning compartment 103. The one or more cleaning brushes 105 may be secured to a top plate 115 or lid 113 positioned over the open end on the upper portion 112 of the cleaning compartment 103. In one embodiment, there may be two cleaning brushes 105 with each of the cleaning brushes 105 located equidistant from a center line of the cleaning compartment 103. In embodiments with two cleaning brushes 105, the cleaning brushes 105 may be cooperatively configured to clean hair from a hairbrush positioned between the two cleaning brushes 105.

Each cleaning brush 105 may include a core, which carries a plurality of cleaning bristles. The cleaning bristles may be located around an entirety of a perimeter of the core. The core may be hollow or solid. In one embodiment, the core may include a protuberance adapted to be retained by a cleaning cylinder 116. The protuberance of the cleaning brush 105 may be cooperatively configured with the cleaning cylinder 116 to retain a portion of the cleaning brush 105 within the cleaning cylinder 116 and secure the cleaning brush 105 thereto.

A top plate 115 may be positioned over the open end at the upper portion 108 of the motor compartment 108 and a portion of the open end at the upper portion 112 of the cleaning compartment 103. The top plate 115 may include a first portion 117, which is positioned over the motor compartment 108 and a second portion 118, which is positioned over the cleaning compartment 103. A cover plate 119 may secure to the top of the top plate 115 and form a cavity therebetween. A first gear 121, second gear 124, and third gear 124 may be positioned within this cavity. There may be a plurality of apertures or openings located on a surface of the cover plate 119, which align with a plurality of apertures or openings located on a surface of the top plate 115. These apertures or openings may be configured to receive a fastener, such as a bolt, screw, or the like, which may secure the cover plate 119 to the top plate 115. There may be apertures located on the top plate 115 and configured to align with an aperture or opening in the cover plate 119 and in the motor compartment 101 to secure the cover plate 119, top plate 115, and motor compartment 101 to one another.

Figure 31:
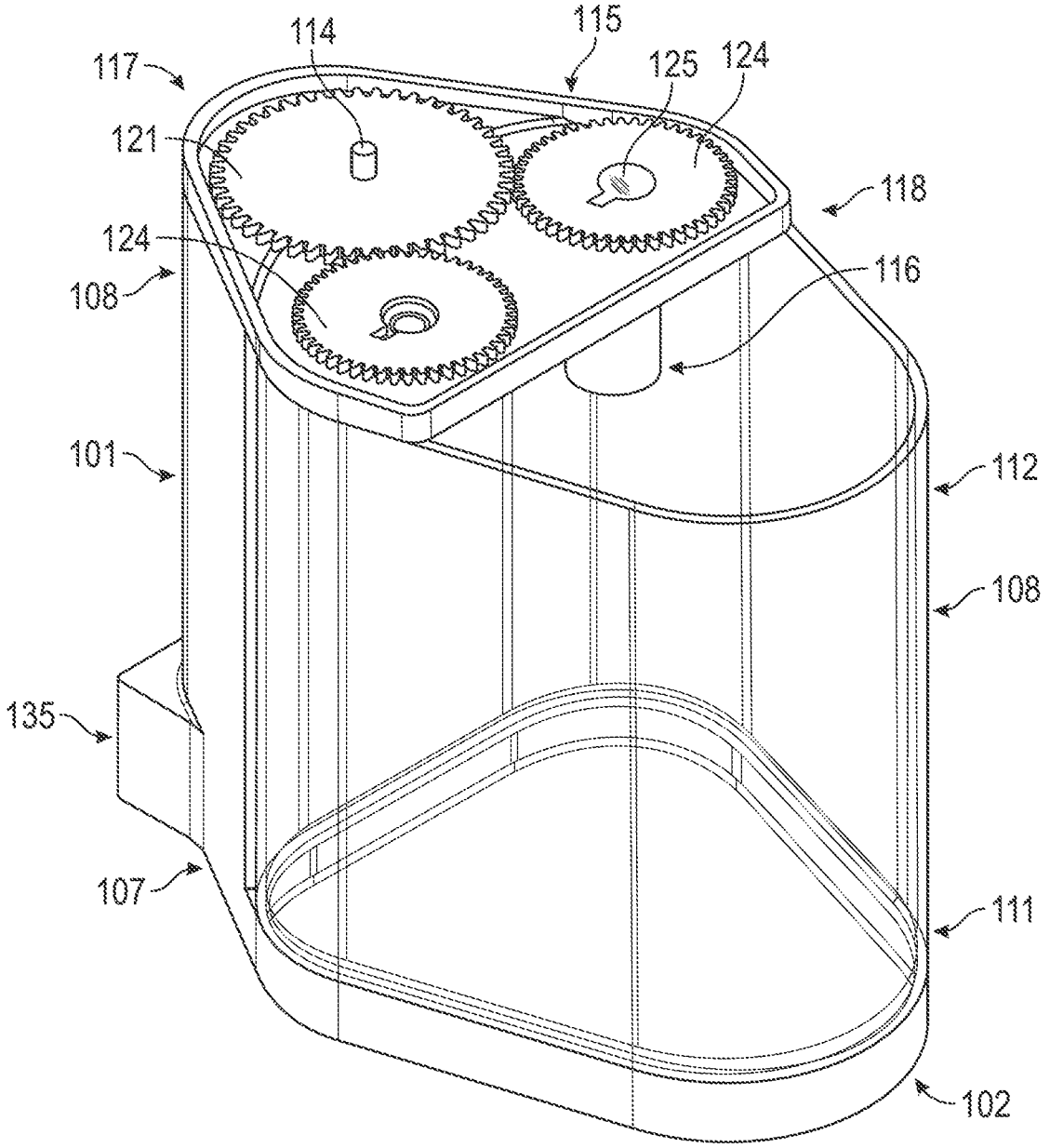
FIG. 31 is a perspective view of the hairbrush cleaner of FIG. 1 with the cover plate, lid, one cleaning brush, one cleaning cylinder adapter, and one cleaning cylinder removed.

In addition to apertures or openings for fastening the top plate 115 to the cover plate 119 and motor compartment 101, the cover plate 119 may include three apertures located through an entirety of a thickness of the cover plate 119 from a first side to an opposing second side. A first aperture 120 may be located in a first portion 117 of the top plate 115 and positioned above the motor 104, centered on the axle 114. The axle 114 may extend through the first aperture 120 and carry a first gear 121 as depicted in FIG. 31.

A bottom surface of the top plate 115 may include an alignment receptacle 136, which may align and receive a top end of the axle 114 when the top plate 115 is positioned over and secured to the motor compartment 101.

A second aperture 122 and a third aperture 123 may be located in the second portion 118 of the top plate 115 and positioned above the cleaning compartment 103. Each of the second aperture 122 and third aperture 123 may receive at least a portion of a core of a respective cleaning brush 105. A second gear 124 may be positioned around and centered upon the second aperture 122. An identical third gear 124 may be positioned around and centered upon the third aperture 123.

A separate cleaning cylinder adapter 125 may be carried within the center of each of the second gear 124 and third gear 124. The cleaning cylinder adapter may have a closed or open first end 126 and an opposing, open second end 127. The first end 126 of the cleaning cylinder adapter 125 may be positioned above the second portion 118 of the top plate 115 and surrounded by the second gear 124 or third gear 124. The bottom surface of the second end 127 of the cleaning cylinder adapter 125 may be positioned below a top surface of the top plate 115. The top surface of the closed first end 126 may be positioned flush with the top surface of the second or third gear 124. The perimeter of the first end 126 of the cleaning cylinder adapter 125 may be circular with a protuberance 129 extending outwardly from an outer surface of the circular circumference of the first end 126 of the cleaning cylinder adapter 125 beyond an outer perimeter of the cleaning cylinder adapter 125. The protuberance may be cooperatively configured to be received by a recess 130 in the second or third gear 124. This configuration may cause rotation of the cleaning cylinder adapter 125 when the second or third gear 124, to which the cleaning cylinder adapter 125 is secured, rotates.

The teeth of the first gear 121 may interlock with the teeth of the second gear 124 or third gear 124 as shown in FIG. 31. Rotation of the motor 104 may cause rotation of the axle 114, which rotates the first gear 121, which rotates the second and third gears 124, which rotates the cleaning cylinder adapter 124, which rotates, the cleaning cylinder 116, which rotates the cleaning brush 105, which removes hair collected on a hairbrush positioned within the cleaning compartment 103 and in contact with the cleaning brush 105.

The second end 127 of the cleaning cylinder adapter 125 may have an opening 128 adapted to receive a portion of a screw, bolt, or the like, which secures to the cleaning cylinder 116. In one embodiment, the opening 128 may be circular and extend through an entirety of a length of the cleaning cylinder adapter 125 from the first end 126 to the second end 127. The second end 127 may be cylindrical. The second end 127 may be adapted to mate with an opening 130 on a first end of a cleaning cylinder 116. An interior surface of the cleaning cylinder 116 may be threaded and adapted to mate with a bolt, screw or the like, which may be carried by an aperture aligned with a center of the top surface of the cleaning cylinder adapter 125, extending into the opening 128 and the opening on a top surface of the cleaning cylinder 116. A bottom surface of the cleaning cylinder adapter 126 may be located above, flush with, or below a bottom surface of the top plate 115. A portion of the cleaning cylinder 116 may extend into an aperture of or above the top plate 115 to mate with the cleaning cylinder adapter 126. A remainder of the cleaning cylinder 116 may be positioned below the top plate 115. The cleaning cylinder 116 may secure to the cleaning cylinder adapter using a bolt, screw, or the like.

The cleaning cylinder 116 may be secured to the second end 127 of the cleaning cylinder adapter 125. The cleaning cylinder 116 may extend downwardly from the connection to the cleaning cylinder adapter 125 and be positioned below the top plate 115 within the interior volume of the cleaning compartment 103. A cleaning brush 105 may removably secure to and be carried by the cleaning cylinder 11 and positioned within the interior volume of the cleaning compartment 103.

Figure 22:
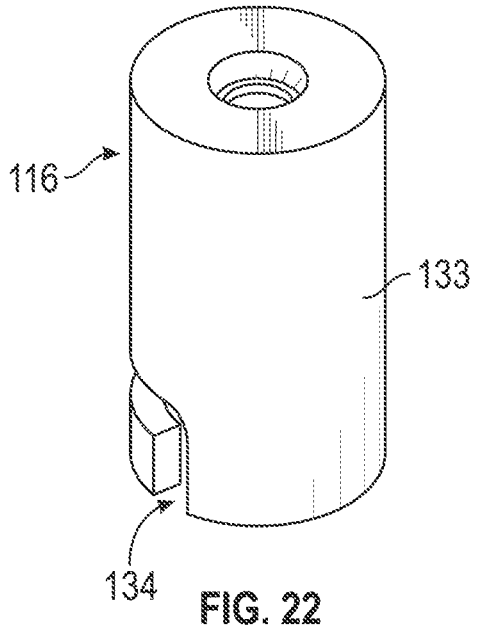
FIG. 22 is a perspective view of the cleaning cylinder of the hairbrush cleaner of FIG. 1.
Figure 23:
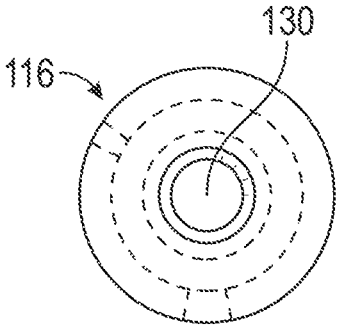
FIG. 23 is a bottom plan view of the cleaning cylinder of FIG. 22.
Figure 24:
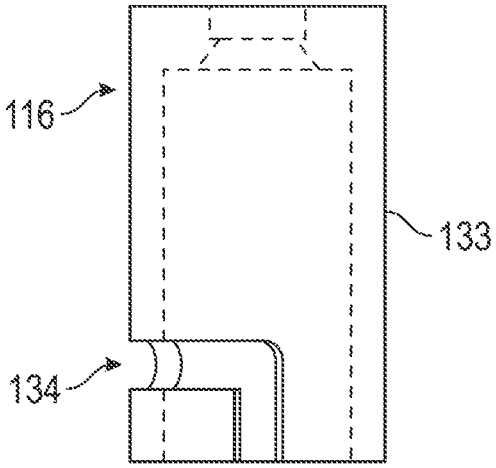
FIG. 24 is a side elevation view of the cleaning cylinder of FIG. 22.
Figure 25:
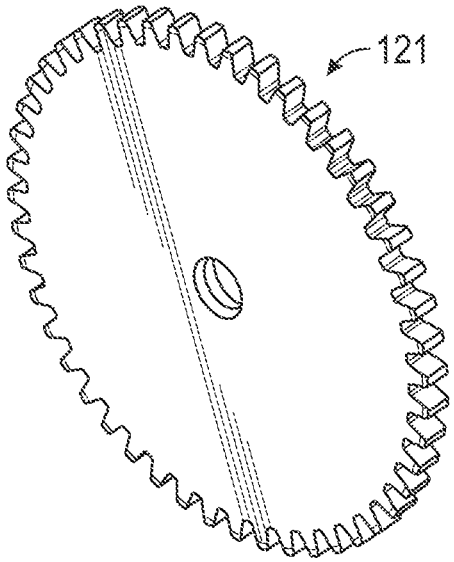
FIG. 25 is a perspective view of the first gear of the hairbrush cleaner of FIG. 1.
Figure 26:
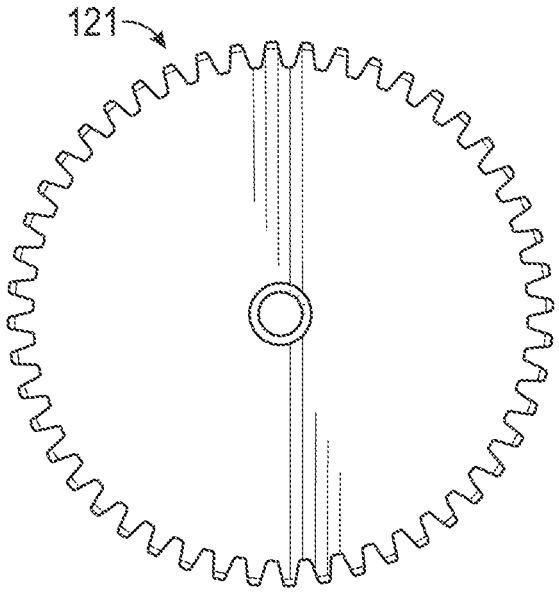
FIG. 26 is a top plan view of the first gear of FIG. 25.
Figure 27:
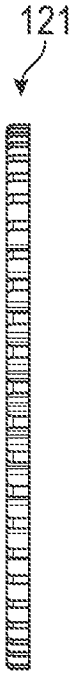
FIG. 27 is a side elevation view of the first gear of FIG. 25.
Figure 28:
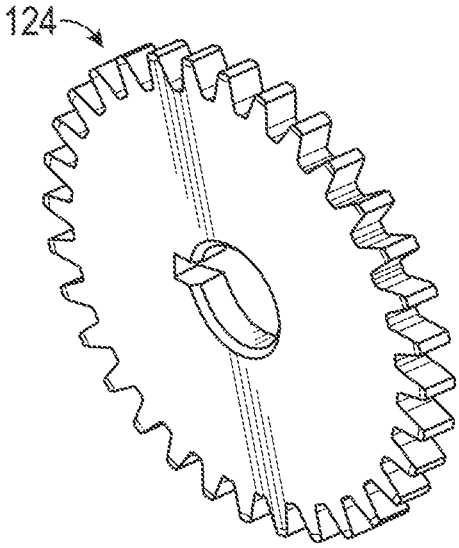
FIG. 28 is a perspective view of the second or third gear of the hairbrush cleaner of FIG. 1.
Figure 29:
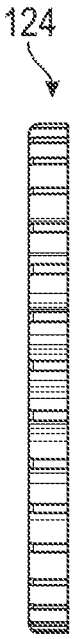
FIG. 29 is a side elevation view of the second or third gear of FIG. 28.
Figure 30:
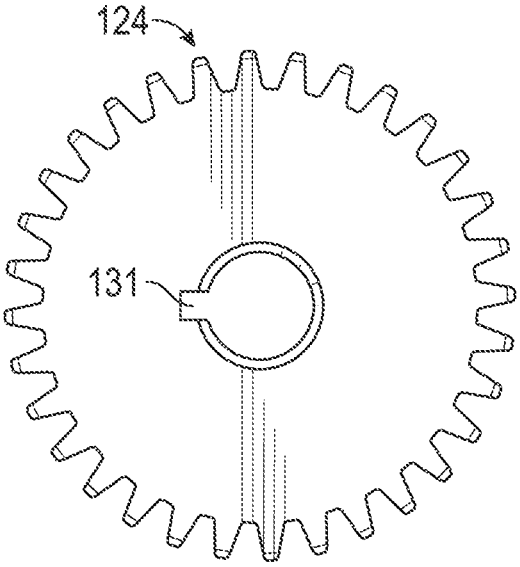
FIG. 30 is a top plan view of the second or third gear of FIG. 28.

The cleaning cylinder 116 may include a sidewall 133 extending down from the first end. An interior side of the sidewall 133 may define an interior cavity of the cleaning cylinder. A slot 134 may be located through a portion of the sidewall 133. The slot 134 may begin at a second end of the cleaning cylinder 116 and extend from the bottom surface of the cleaning cylinder 116 to a portion of the cleaning cylinder 116 removed from the bottom surface of the cleaning cylinder 116 through an entirety of a thickness of the sidewall 133 of the cleaning cylinder 116 from the exterior surface to the interior cavity as depicted in FIGS. 22 and 24. The slot 134 may turn to form an angle and be adapted to secure a cleaning brush 105 within the cleaning cylinder 116. In one embodiment, the slot 134 may extend upwardly perpendicular to the bottom surface of the second end and turn approximately 90 degrees to extend parallel to the bottom surface of the second end. Each cleaning brush 105 may have a protuberance located on a core of the cleaning brush 105 and adapted to be received and removably retained within the slot.

The cleaning cylinder 116 may include a hollow cylinder with threads positioned along an opening located at a first end of the cleaning cylinder 116. The first end may mate with the cleaning cylinder adapter 125 and be secured thereto by a bolt, screw, or the like. The second end may be open and adapted to receive a cleaning brush 105. The centers of the cleaning cylinder 116, cleaning cylinder adapter 125, and respective gear 124 may be aligned.

Figure 19:
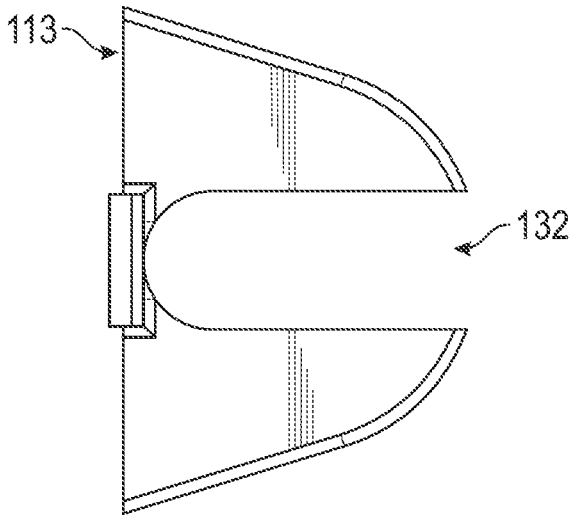
FIG. 19 is a top plan view of the lid of FIG. 18.
Figure 20:
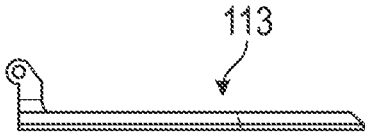
FIG. 20 is a side elevation view of the lid of FIG. 18.
Figure 21:
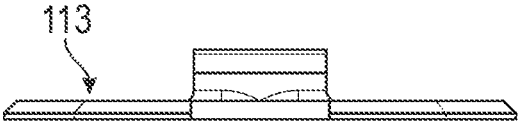
FIG. 21 is a front elevation view of the lid of FIG. 18.

The lid 113 may hingedly secure to a second portion 118 of the top plate 115. The lid may extend away from the top plate 115 and be configured to have a perimeter aligned with a perimeter of the cleaning compartment 103 so that the second portion 118 of the top plate 115 and the lid 113 cooperatively cover an entirety of the opening at the upper portion 112 of the cleaning compartment with the exception of the area that is located within the slot 132 of the lid 113. The slot 132 extends from an outer perimeter of the lid 113 distal the hinge inwardly toward the position of the hinge and is defined by sidewalls of the lid 113 positioned above and within the perimeter of the cleaning compartment 103. The slot 132 may be U-shaped with the open end positioned along the outer perimeter of the lid 113 as depicted in FIG. 19. The slot 132 may be sized to allow a hairbrush handle to extend above the cleaning compartment 103 while the hairbrush bristles are positioned within the cleaning compartment 103 and the lid is closed over the cleaning compartment 103.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

The invention claimed is:

1. A hairbrush cleaner comprising:

a motor compartment;

a cleaning compartment receptacle secured to a lower portion of the motor compartment a cleaning compartment having a lower portion carried by the cleaning compartment receptacle;

a motor having an axle carried within the motor compartment;

a first cleaning brush suspended within the cleaning compartment receptacle and connected to the motor whereby rotation of the axle of the motor causes rotation of the first cleaning brush;

a top plate having a first portion secured to a perimeter of an upper portion of the motor compartment and a second portion secured to a portion of a perimeter of an upper portion of the cleaning compartment; and a lid hingedly secured to the top plate and adapted to cover a portion of an upper opening of the cleaning compartment not covered by the top plate.

2. The hairbrush cleaner of claim 1 wherein the first cleaning brush comprises:

a core; and a plurality of cleaning bristles carried by the core.

3. The hairbrush cleaner of claim 1 wherein the cleaning compartment comprises:

a vessel configured to carry a fluid and submerge at least a portion of the first cleaning brush within the fluid.

4. The hairbrush cleaner of claim 1 wherein the lid comprises:

a slot configured to receive a hairbrush having a handle and a plurality of hairbrush bristles, wherein the handle is positioned within the slot and the plurality of hairbrush bristles are positioned within the cleaning compartment.

5. The hairbrush cleaner of claim 1 wherein the top plate comprises:

a first aperture located through an entirety of a thickness of the first portion of the top plate and adapted to receive an axle connected to the motor; and a second aperture located through an entirety of a thickness of the second portion of the top plate and adapted to carry a first cleaning cylinder adapter.

6. The hairbrush cleaner of claim 5 further comprising:

the first cleaning cylinder adapter having a first end with a top surface positioned above a top surface of the second portion of the top plate and a second end having a bottom surface with a first cleaning cylinder adapter opening located below the top surface of the second portion of the top plate, wherein a center of the first cleaning cylinder adapter opening is aligned with a center of the second aperture.

7. The hairbrush cleaner of claim 6 further comprising:

a protuberance secured to the first end of the first cleaning cylinder adapter, extending beyond an outer perimeter of the first cleaning cylinder adapter, and positioned above the top plate.

8. The hairbrush cleaner of claim 7 further comprising:

a first gear carried by the axle connected to the motor; and a second gear carried by the protuberance and having teeth interlocked with teeth of the first gear.

9. The hairbrush cleaner of claim 8 further comprising:

a cover plate secured to an upper surface of the top plate forming a cavity therebetween; and wherein the first gear and second gear are positioned within the cavity.

10. The hairbrush cleaner of claim 6 further comprising:

a first cleaning cylinder secured to the second end of the first cleaning cylinder adapter and located below the top plate, wherein a center of the first cleaning cylinder is aligned with the center of the first cleaning cylinder adapter and the first cleaning cylinder carries the first cleaning brush.

11. The hairbrush cleaner of claim 10 wherein the first cleaning cylinder further comprises:

a sidewall defining an exterior surface and an interior cavity; and a slot located through an entirety of a thickness of the sidewall from the exterior surface to the interior cavity; and wherein the first cleaning brush comprises a protuberance adapted to be received by the slot.

12. The hairbrush cleaner of claim 5 wherein the top plate further comprises:

a third aperture located through an entirety of a thickness of the second portion of the top plate and adapted to carry a second cleaning cylinder adapter.

13. The hairbrush cleaner of claim 12 further comprising:

the first cleaning cylinder adapter having a first end positioned above a top surface of the second portion of the top plate and a second end having a bottom surface with a first cleaning cylinder adapter opening located below the top surface of the second portion of the top plate, wherein a center of the first cleaning cylinder adapter opening is aligned with a center of the second aperture; and the second cleaning cylinder adapter having a first end positioned above a top surface of the second portion of the top plate and a second end having a bottom surface with a second cleaning cylinder adapter opening located below the top surface of the second portion of the top plate, wherein a center of the second cleaning cylinder adapter opening is aligned with a center of the third aperture.

14. The hairbrush cleaner of claim 13 further comprising:

a first cleaning cylinder secured to the second end of the first cleaning cylinder adapter and located below the top plate, wherein a center of the first cleaning cylinder is aligned with the center of the first cleaning cylinder adapter and the first cleaning cylinder carries the first cleaning brush;

a second cleaning brush suspended within the cleaning compartment receptacle and connected to the motor whereby rotation of the motor causes rotation of the second cleaning brush; and a second cleaning cylinder secured to the second end of the second cleaning cylinder adapter and located below the top plate, wherein a center of the second cleaning cylinder is aligned with the center of the second cleaning cylinder adapter and the second cleaning cylinder carries the second cleaning brush.

15. The hairbrush cleaner of claim 13 further comprising:

a first protuberance secured to the first end of the first cleaning cylinder adapter, extending beyond an outer perimeter of the first cleaning cylinder adapter, and positioned above the top plate; and a second protuberance secured to the first end of the second cleaning cylinder adapter, extending beyond an outer perimeter of the second cleaning cylinder adapter, and positioned above the top plate.

16. The hairbrush cleaner of claim 15 further comprising:

a first gear carried by the axle connected to the motor;

a second gear carried by the first protuberance and having teeth interlocked with teeth of the first gear; and a third gear carried by the second protuberance and having teeth interlocked with the teeth of the first gear.

17. A hairbrush cleaner comprising:

a motor compartment;

a cleaning compartment receptacle secured to a lower portion of the motor compartment;

a cleaning compartment having a lower portion carried by the cleaning compartment receptacle, wherein the cleaning compartment comprises:

a vessel configured to carry a fluid and submerge at least a portion of a first cleaning brush and a second cleaning brush within the fluid;

a motor having an axle carried within the motor compartment;

the first cleaning brush suspended within the cleaning compartment receptacle and connected to the motor whereby rotation of the axle of the motor causes rotation of the first cleaning brush, wherein the first cleaning brush comprises:

a first core, and a first plurality of cleaning bristles carried by the first core;

the second cleaning brush suspended within the cleaning compartment receptacle and connected to the motor whereby rotation of the axle of the motor causes rotation of the second cleaning brush, wherein the second cleaning brush comprises:

a second core, and a second plurality of cleaning bristles carried by the second core;

a top plate having a first portion secured to a perimeter of an upper portion of the motor compartment and a second portion secured to a portion of a perimeter of an upper portion of the cleaning compartment, wherein the top plate comprises:

a first aperture located through an entirety of a thickness of the first portion of the top plate and adapted to receive an axle connected to the motor, a second aperture located through an entirety of a thickness of the second portion of the top plate and adapted to carry a first cleaning cylinder adapter, and a third aperture located through an entirety of the thickness of the second portion of the top plate and adapted to carry a second cleaning cylinder adapter;

a lid hingedly secured to the top plate and adapted to cover a portion of an upper opening of the cleaning compartment not covered by the top plate, wherein the lid comprises:

a slot configured to receive a hairbrush having a handle and a plurality of hairbrush bristles, wherein the handle is positioned within the slot and the plurality of hairbrush bristles are positioned within the cleaning compartment;

the first cleaning cylinder adapter having a first end with a top surface positioned above a top surface of the second portion of the top plate and a second end having a bottom surface with a first cleaning cylinder adapter opening located below the top surface of the second portion of the top plate, wherein a center of the first cleaning cylinder adapter opening is aligned with a center of the second aperture;

the second cleaning cylinder adapter having a first end with a top surface positioned above a top surface of the second portion of the top plate and a second end having a bottom surface with a second cleaning cylinder adapter opening located below top surface of the second portion of the top plate, wherein a center of the second cleaning cylinder adapter opening is aligned with a center of the third aperture;

a first cleaning cylinder secured to the second end of the first cleaning cylinder adapter and located below the top plate, wherein a center of the first cleaning cylinder is aligned with the center of the first cleaning cylinder adapter and the first cleaning cylinder carries the first cleaning brush, wherein the first cleaning cylinder comprises:

a first sidewall defining an exterior surface and an interior cavity, and a first slot located through an entirety of a thickness of the first sidewall from the exterior surface to the interior cavity, and wherein the first cleaning brush comprises a first brush protuberance adapted to be received by the first slot;

a second cleaning cylinder secured to the second end of the second cleaning cylinder adapter and located below the top plate, wherein a center of the second cleaning cylinder is aligned with the center of the second cleaning cylinder adapter and the second cleaning cylinder carries the second cleaning brush, wherein the second cleaning cylinder comprises:

a second sidewall defining an exterior surface and an interior cavity, and a second slot located through an entirety of a thickness of the second sidewall from the exterior surface to the interior cavity, and wherein the second cleaning brush comprises a second brush protuberance adapted to be received by the second slot;

a first adapter protuberance secured to the first end of the first cleaning cylinder adapter, extending beyond an outer perimeter of the first cleaning cylinder adapter, and positioned above the top plate;

a second adapter protuberance secured to the first end of the second cleaning cylinder adapter, extending beyond an outer perimeter of the second cleaning cylinder adapter, and positioned above the top plate;

a first gear carried by the axle connected to the motor;

a second gear carried by the first adapter protuberance and having teeth interlocked with teeth of the first gear;

a third gear carried by the second adapter protuberance and having teeth interlocked with the teeth of the first gear;

a cover plate secured to an upper surface of the top plate forming a cavity therebetween; and wherein the first gear, second gear, and third gear are positioned within the cavity.

* * * * *